US005530175A

United States Patent [19]

Johnson et al.

[11] Patent Number: 5,530,175

[45] Date of Patent: Jun. 25, 1996

[54] DISPOSAL OF EXPLOSIVE D

[75] Inventors: Russell W. Johnson, Elmhurst; Robert H. Sedath, Bensenville; Mark B. Koch, Mt. Prospect, all of Ill.

[73] Assignee: AlliedSignal Inc., Morris Township, Morris County, N.J.

[21] Appl. No.: 361,607

[22] Filed: Dec. 22, 1994

[51] Int. Cl.[6] ..... A62D 3/00

[52] U.S. Cl. ..... 588/203; 149/124

[58] Field of Search ..... 588/202, 203; 149/124

[56] References Cited

U.S. PATENT DOCUMENTS 4,661,179 4/1987 Hunter et al. ..... 149/124
4,804,480 2/1989 Tayawant ..... 210/759
5,232,605 8/1993 Baur et al. ..... 210/761

FOREIGN PATENT DOCUMENTS

413147A1 3/1993 Germany .

*Primary Examiner*—Ngoclan Mai
*Attorney, Agent, or Firm*—Harold N. Wells; Jay P. Friedenson; Roger H. Criss

[57] ABSTRACT

A method for converting Explosive D, i.e., ammonium picrate to oxygenated products, particularly hydroquinone or cyclohexanediol and ammonia by hydrogenation over a supported Group VIII metal catalyst. Preferably, the ammonium picrate is dissolved in a suitable solvent and then hydrogenated at a temperature of about 25° to 250° C., and a pressure of about 10 to 1000 psig (69 to 6900 kPa gauge) followed by separation of the commercially valuable products and ammonia.

17 Claims, 1 Drawing Sheet

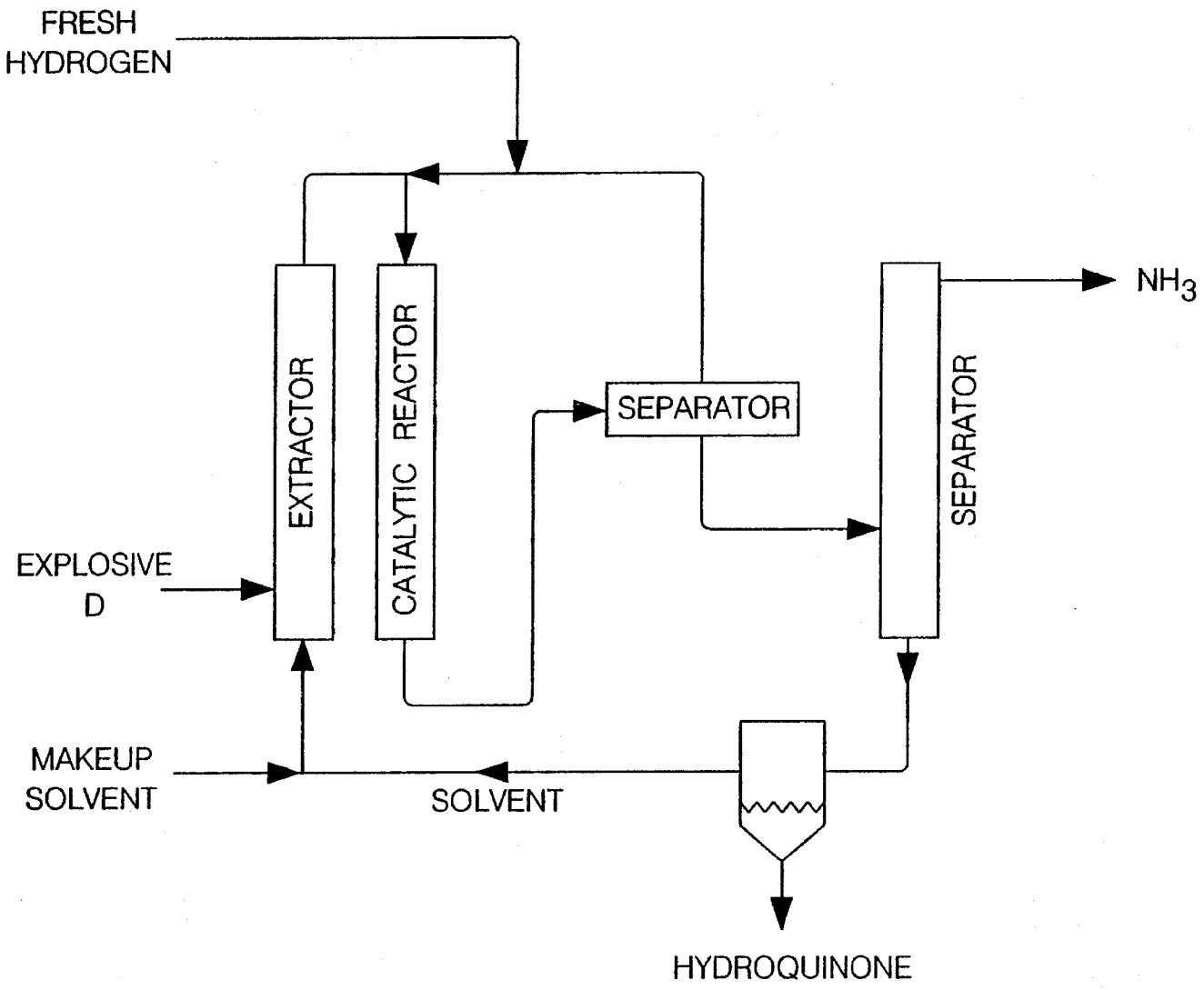
FRESH HYDROGEN
EXTRACTOR
CATALYTIC REACTOR
SEPARATOR
EXPLOSIVE D
MAKEUP SOLVENT
SOLVENT
SEPARATOR
$NH_3$
HYDROQUINONE

DISPOSAL OF EXPLOSIVE D

BACKGROUND OF THE INVENTION

The invention relates generally to the disposal of energetic materials and more particularly to the conversion of Explosive D, i.e., ammonium pierate into useful products.

Ammonium pierate could be destroyed by such methods as incineration or decomposition in supercritical water, but it would be preferable if the products of the disposal method had commercial value. It was the purpose of the present inventors to develop a method for convenient disposal of ammonium pierate which has the least adverse impact on the environment while at the same time produces valuable by-products.

Destruction of nitrogen-containing explosives has been the subject is of various disclosures. German patent publication DE 413147-A1 discusses the hydrogenation of nitroaromatic explosives in the presence of an alcohol solvent, hydrogen, and a catalyst at a temperature of 40° C. to 100° C. U.S. Pat. No. 4,661,179 discloses a process for destroying waste explosives containing nitro, nitrate, or nitroamino groups by hydrogenation.

The present inventors have found that it is possible to produce useful oxygenated products such as hydroquinone, cyclohexanone, cyclohexanol, and cyclohexanediol by hydrogenation of ammonium picrate.

SUMMARY OF THE INVENTION

Broadly, the invention is a method for disposal of ammonium pierate by hydrogenation to oxygenated products, particularly hydroquinone and cyclohexanediol.

In one embodiment, the process involves dissolving the ammonium pierate in a suitable liquid carrier, such as water, alcohols, and hydrocarbons, e.g., methanol, toluene, or methylcyelohexane, preferably in a ratio of solvent to explosive of about 7/1 to 25/1 by weight, and then reacting the dissolved ammonium pierate with hydrogen in a mixed phase reaction over a supported Group VIII metal catalyst at a temperature of about 25° to 250° C. and a pressure of about 10 to 1000 psig (69 to 6900 kPa gauge). The oxygenated product is recovered and then the solvent and any unreacted ammonium pierate may be returned to the process. The process conditions will be adjusted to provide the desired products, such as hydroquinone and cyclohexanediol.

Preferred Group VIII metals are platinum, palladium, nickel and cobalt, particularly palladium, most preferably about 1 to 5 wt.% Pd on a carbon support.

DESCRIPTION OF THE DRAWINGS

The sole FIGURE is a flow sheet illustrating the process of the invention.

DESCRIPTION OF THE PREFERRED EMBODIMENTS

Explosive D

Explosive D or ammonium pierate is a chemical relative of such familiar explosives as TNT (trinitrotoluene) and DNT (dinitrotoluene) which have been hydrogenated according to the prior art to form the corresponding amines. Severe hydrogenation may produce further destruction of the explosive molecules. The formula for ammonium pierate is:

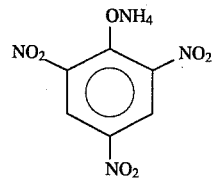

It has been an objective of the present inventors to provide a safe and convenient method of disposing of such material and to produce commercially saleable products rather than merely destroying the Explosive D.

Catalysts

Group VIII metals are generally suitable for hydrogenation reactions particularly Pt, Pd, Ni, and Co. Although other hydrogenation catalysts may have use in the process of the invention, the noble metals of Group VIII are preferred, particularly Pal. The catalytic metals could be used alone in finely divided particulate form, but preferably they will be supported on solids such as carbon, alumina, silica or titania. In preferred embodiments the noble metal is deposited on a support in an amount between about 0.5 and 5 wt.% based on the finished catalyst. This may be accomplished by various techniques known to those skilled in the art, such as impregnation of the support with a solution of a noble metal compound followed by heating to decompose the noble metal compound, leaving a finely dispersed metal. Other methods may also be used such as coprecipitation of the metal compound and the support material from solution.

Mixed Phase Reaction

In a preferred embodiment, a solvent is used to dissolve and dilute the ammonium pierate. The solvent chosen preferably will be selected from a group generally consisting of water, alcohols, and hydrocarbons. More particularly, the solvent should be capable of dissolving up to at least 50 wt. % of ammonium pierate, although typically the solvent will contain less than 30 wt. %. Higher concentrations of ammonium pierate may be used if desired. Preferably, a ratio of solvent to ammonium pierate of about 7/1 to 25/1 by weight will be used. Since the solvent, among other things, serves to moderate the effect of the exothermic heat of reaction, it will be appreciated that selection of the amount of solvent will affect the design of the entire process. The solvent should be inert with respect to the ammonium pierate so that it acts as a carrier only and produces no undesirable by-products with it. Additionally, the solvent should not react significantly with hydrogen under conditions of the invention so that it can be recovered and recycled to the reaction without a need to remove hydrogenated by-products.

Considering the above requirements, the solvents which are preferred for the hydrogenation of ammonium pierate are hydrocarbons such as kerosine, naphtha, methylcyclohexane, decalin, and the like or alcohols such as methanol, ethanol and isopropanol. Water is useful although since the products will contain water they may have to be dried.

While the solvents will ordinarily be selected because they are inert, it is possible to use a solvent which undergoes a reaction with hydrogen or which produces hydrogen. An example is methylcyclohexane, which can dehydrogenate when exposed to a noble metal catalyst, thus producing hydrogen for use in the reaction with the ammonium pierate, but also balancing the exothermic heat of reaction with the endothermic heat of the dehydrogenation.

Reaction Conditions

The reaction of a hydrogen with ammonium picrate under controlled conditions will be shown below to produce principally hydroquinone or cyclohexanediol, depending on the process conditions. Other oxygenated products such as cyclohexanone and cyclohexanol may be produced. The reaction of ammonium pierate with hydrogen to form hydroquinone may be written as follows:

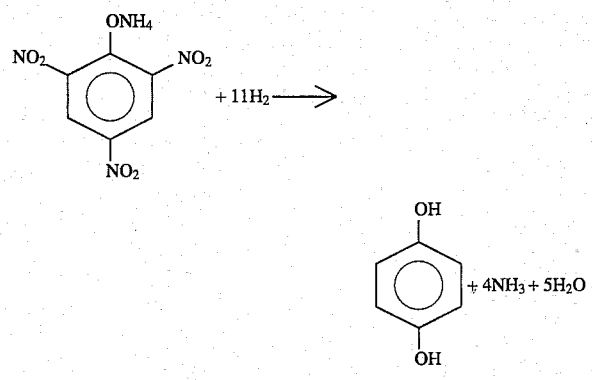

Hydrogenation may be carried out at a temperature of about 25° to 250° C., preferably 120° to 150° C. A low temperature is preferred but practical considerations may require higher temperatures be used to obtain the optimum conversion of the ammonium pierate and selectivity to the desired products..

The reaction will generally be carried out with a positive pressure, preferably between about 10 to 1000 psig (69 to 6900 kPa gauge), preferably about 100 to 700 psig (689 to 4826 kPa gauge).

Hydrogen will be maintained at mol ratio of about 5/1 to 50/1 relative to the ammonium pierate. Although the reaction requires eleven mols of hydrogen for each tool of ammonium pierate reacted to make hydroquinone, more is required to saturate the aromatic ring and produce cyclohexanone derivatives, such as cyclohexanediol. Lower amounts of hydrogen could be used to control the reaction, although the conversion necessarily is reduced. Under the reaction temperature and pressure the ammonium pierate containing solvent will be liquid and the hydrogen is a gas so that a two-phase mixture will be passed over the supported catalyst at a liquid hourly space velocity based on the ammonium picrate of about 0.1 to 10 $hr^{-1}$, preferably between 0.5 and 1 $hr^{-1}$.

Process Description

The sole FIGURE illustrates an embodiment of the process of the invention in which hydroquinone is produced. The ammonium pierate to be converted to less energetic materials, such as hydroquinone and ammonia, is first removed from its container, (not shown) and dissolved in the selected solvent. Ammonium pierate is a solid under ambient conditions. The dilution of the ammonium picrate will assist in controlling the exothermic heat of the hydrogenolysis reaction. Accordingly, the ammonium pierate and the solvent will be metered to provide the desired concentration, generally up to about 30 weight percent at the outlet of the extractor. Since the catalytic reaction will ordinarily not be complete, the recycled solvent will contain a significant amount of the unreacted ammonium pierate. Thus, the fresh ammonium pierate would be added at the rate needed to makeup for the ammonium pierate converted and to provide a constant concentration at the inlet of the catalytic reactor.

The solvent containing diluted ammonium pierate is passed to a catalytic reactor along with added hydrogen over the supported Group VIII metal catalyst to convert the ammonium pierate to hydroquinone and ammonia. The amount of hydrogen is metered to provide the desired mol ratio of hydrogen to ammonium pierate. If desired, the amount of hydrogen may be limited to only that required to react with the ammonium pierate. However, in most cases an excess will be used and the unreacted hydrogen will be separated at the outlet of the reactor and recycled as shown.

The reactor may be of various types known in the art where solid catalysts are contacted with liquid, gas, or mixed phase streams. Since the heat of reaction is substantial, it must be removed to control the reaction and to assure is that the desired products are obtained. Thus, heat removal means are preferred which could include internal cooling coils, but preferably the reactor is constructed in the form of a shell and tube heat exchanger. The catalyst would be disposed within the tubes and the shell side would be filled with the cooling fluid. Since the reaction temperature is relatively low cooling by water may be sufficient. Alternatively, silicone fluids, hydrocarbons, and the like could be used.

After leaving the reactor, the mixed-phase stream passes to a separator where excess hydrogen is removed and the liquid phase then is passed to a fractionator for removing and separating the ammonia and hydroquinone produced. Typically, a distillation column will be used. The hydroquinone and solvent are removed from the bottom of the column and passed to a separator where hydroquinone is removed by precipitation. Thereafter the solvent may be recycled to dissolve fresh ammonium pierate.

Although a continuous process as described would be preferred, it is also feasible to carry out the reaction in a batch mode, as in the followingexamples.

Example 1

Hydrogenation of ammonium pierate was carried out in a batch reaction. 0.02 gram-moles of ammonium pierate was dissolved in 5.2 gram-moles of water in a 460 mL Parr autoclave. One g of 1 wt. % Pd on steam-activated carbon granules (AESAR, Johnson Matthey, Inc.) was added. After flushing the reactor with nitrogen, the nitrogen was replaced with hydrogen and pressured to 675 psig (4654 kPa). Then the reactor was heated to 180° C. with stirring and held at constant conditions for 4 hours until the reaction was substantially complete. The pressure rose to about 800 psig (5515 kPa). The reactor then was cooled to less than 20° C. in an ice bath and then emptied for analysis. The reactor was vented to atmospheric pressure with the gases passing through an acid scrubber containing 2 wt. % HCl. The hydroquinone was measured by gas chromatography/mass spectroscopy (GC/MS) of the liquids in the reactor and the acid scrubber. The yield of hydroquinone was measured and found to be greater than 90% of the organic material in the liquid phase.

Example 2

The experiment of Example 1 was repeated using a lower pressure and temperature and producing cyclohexananediol rather than hydroquinone. 0.004 gram-moles of ammonium picrate was dissolved in 5.5 gram-moles of water in a 460 mL Parr autoclave. One g of 1 wt. % Pd on steam-activated carbon granules (AESAR, Johnson Matthey, Inc.) was added. After flushing the reactor with nitrogen, the nitrogen was replaced with hydrogen and pressured to 100 psig (689 kPa). Then the reactor was heated to 150° C. with stirring and held at constant conditions for 24 hours until the reaction was substantially complete. The pressure rose to about 150 psig (1034 kPa). The reactor then was cooled to less than 20° C. in an ice bath and then emptied for analysis. The reactor was vented to atmospheric pressure with the gases passing through an acid scrubber containing 2 wt. % HCI. The cyclohexanediol product was measured by GC/MS of the liquids in the reactor and the acid scrubber. The yield of cyclohexanediol was measured and found to be greater than 80% of the organic material in the liquid phase.

It can be seen from the results of Examples 1 and 2 that Explosive D (ammonium picrate) can be hydrogenated under controlled conditions to produce valuable product. Further, it will be evident that the nature of the products can be controlled by adjustment of the reaction conditions, in the examples either hydroquinone or cyclohexanediol were produced depending on the conditions employed.

We claim:

1. A method of converting ammonium pierate to oxygenated products and ammonia comprising:

(a) dissolving said ammonium pierate in a suitable liquid carrier;

(b) passing said dissolved ammonium pierate of (a) over a Group VIII metal catalyst at a temperature of 25° to 250° C. and a pressure of 10 to 1000 psig (69 to 6900 kPa) in the presence of about 5 to 50 mols of hydrogen for each tool of ammonium pierate, thereby producing by hydrogenolysis oxygenated products and ammonia;

(c) recovering the oxygenated products and ammonia from the product of (b) and optionally returning the liquid carrier to step (a).

2. The method of claim 1 wherein said oxygenated products are one or more members of the group consisting of hydroquinone, cyclohexanone, cyclohexanol, and cyclohexanediol.

3. The method of claim 2 wherein said oxygenated product is hydroquinone.

4. The method of claim 2 wherein said oxygenated product is cyclohexanediol.

5. The method of claim 1 wherein said Group VIII metal catalyst is at least one member of the group consisting of Pt, Pd, Ni, and Co.

6. The method of claim 5 wherein said Group VIII metal is Pd.

7. The method of claim 1 wherein said Group VIII metal catalyst is supported on a member of the group consisting of carbon, alumina, silica, and titania.

8. The method of claim 7 wherein said Group VIII metal catalyst is supported on carbon.

9. The method of claim 1 wherein said liquid carder is at least one member of the group consisting of water, hydrocarbons, and alcohols.

10. The method of claim 9 wherein said liquid carder is water.

11. The method of claim 1 wherein the ratio of solvent to ammonium picrate is about 7/1 to 25/1 by weight.

12. The method of claim 1 wherein said liquid carrier dehydrogenates to produce hydrogen and provides cooling by the endothermic as dehydrogenation reaction.

13. The method of claim 12 wherein said liquid carder is methylcyclohexane.

14. The method of claim 1 wherein said ammonium pierate is introduced to an extraction vessel where it is contacted and dissolved in said liquid carrier.

15. The method of claim 7 wherein said dissolved ammonium pierate of (a) is contacted with a packed bed of said supported noble metal.

16. The method of claim 15 wherein said packed bed is a series of catalyst containing tubes in a heat exchanger.

17. The method of claim 1 wherein the process conditions are adjusted to determine the oxygenated product.

* * * * *